US011471719B2

(12) United States Patent
Silva, Jr. et al.

(10) Patent No.: US 11,471,719 B2
(45) Date of Patent: Oct. 18, 2022

(54) FIRE PROTECTION SPRINKLER ASSEMBLY WITH PRESSURE RELIEF AND RETENTION THREAD

(71) Applicant: Tyco Fire Products LP, Lansdale, PA (US)

(72) Inventors: Manuel R. Silva, Jr., Cranston, RI (US); Steven Lee Shields, Lubbock, TX (US); Gary J. Luiz, Warwick, RI (US)

(73) Assignee: Tyco Fire Products LP, Lansdale, PA (US)

( * ) Notice: Subject to any disclaimer, the term of this patent is extended or adjusted under 35 U.S.C. 154(b) by 147 days.

(21) Appl. No.: 16/645,110

(22) PCT Filed: Sep. 7, 2018

(86) PCT No.: PCT/US2018/050040

§ 371 (c)(1),
(2) Date: Mar. 6, 2020

(87) PCT Pub. No.: WO2019/051288

PCT Pub. Date: Mar. 14, 2019

(65) Prior Publication Data

US 2021/0077843 A1 Mar. 18, 2021

Related U.S. Application Data

(60) Provisional application No. 62/556,078, filed on Sep. 8, 2017.

(51) Int. Cl.
*A62C 37/09* (2006.01)
*B05B 15/656* (2018.01)

(52) U.S. Cl.
CPC ..... *A62C 37/09* (2013.01); *B05B 15/656* (2018.02)

(58) Field of Classification Search
CPC ..... A62C 35/68; A62C 37/11; A62C 37/09; B05B 15/656; B05B 1/265; B05B 15/65;
(Continued)

(56) References Cited

U.S. PATENT DOCUMENTS 2,934,182 A * 4/1960 Neville ..... F16B 5/02 403/408.1
4,007,877 A * 2/1977 Jackson ..... A62C 37/09 239/209

(Continued)

OTHER PUBLICATIONS

International Search Report and Written Opinion for International Application No. PCT/US2018/050040, dated Nov. 14, 2018, 11 pages.

*Primary Examiner* — Tuongminh N Pham
(74) *Attorney, Agent, or Firm* — Foley & Lardner LLP

(57) ABSTRACT

A sprinkler assembly include a connection fitting and a fire protection sprinkler. The connection fitting includes a tubular member with a first insertion end and a second insertion end with an internal conduit extending along a longitudinal axis, the tubular member including an exterior surface and an inner surface, the inner surface defining a sealing surface between the first and second insertion ends circumscribed about the longitudinal axis, the inner surface including a gripping portion spaced from the sealing surface. The fire protection sprinkler has a body defining an inlet and an outlet with a passageway between the inlet and the outlet, a deflector spaced from the outlet, the body having an outer encasing surface surrounding the longitudinal axis and including a leading portion and a trailing portion engaged with the gripping portion, having a first retention section and a second retention section.

18 Claims, 10 Drawing Sheets

(58) Field of Classification Search
CPC ..... F16L 19/02; F16L 19/0206; F16L 19/005; F16L 37/091; F16L 15/008; F16L 15/007; F16L 15/002; F16L 47/04; F16B 39/282; F16B 39/32; B21K 1/56
See application file for complete search history.

(56) References Cited

U.S. PATENT DOCUMENTS

| | | | | |
|---|---|---|---|---|
| 4,252,773 | A | 2/1981 | Spiegel et al. | |
| 2002/0110439 | A1* | 8/2002 | Craven | F16B 5/0275 411/413 |
| 2006/0001850 | A1* | 1/2006 | Dekker | G03F 7/70833 355/53 |
| 2008/0146368 | A1* | 6/2008 | Cole | A63B 53/02 473/307 |
| 2010/0078181 | A1 | 4/2010 | Fischer et al. | |
| 2014/0346256 | A1 | 11/2014 | Abels et al. | |
| 2016/0121149 | A1 | 5/2016 | Pena et al. | |

* cited by examiner

FIRE PROTECTION SPRINKLER ASSEMBLY WITH PRESSURE RELIEF AND RETENTION THREAD

CROSS-REFERENCE TO RELATED APPLICATIONS

The present disclosure claims the benefit of and priority to U.S. Provisional Application No. 62/556,078, titled "FIRE PROTECTION SPRINKLER ASSEMBLY WITH PRESSURE RELIEF AND RETENTION THREAD," filed Sep. 8, 2017.

BACKGROUND

Installed automatic fire protection sprinklers are placed under fluid pressure from firefighting fluid supplied to the installed sprinkler. In order to replace, inspect or maintain an installed sprinkler, it is desirable to relieve fluid (liquid or gas) pressure before completely disconnecting the sprinkler from the fluid supply piping in order to avoid injury.

SUMMARY

Embodiments of a fire protection sprinkler and connection assembly are provided having a tubular connection fitting in which a fire protection sprinkler is coaxially inserted and coupled to form a fluid tight connection. In some embodiments, the external configuration of the sprinkler body and the internal configuration of the fitting cooperate with one another to facilitate coupling and retention of the components and a method of decoupling of the assembly components including removal of fluid pressure.

In some embodiments, a sprinkler assembly includes a sprinkler assembly having a connection fitting including a tubular member with a first insertion end and a second insertion end with an internal conduit extending between the first and second insertion end along a longitudinal axis. The tubular member includes an exterior surface and an inner surface, the inner surface defining a sealing surface between the first and second insertion ends circumscribed about the longitudinal axis. The inner surface includes a gripping portion axially spaced from the sealing surface between the sealing surface and the second insertion end; and a fire protection sprinkler having a body defining an inlet and an outlet with a passageway extending between the inlet and the outlet along the longitudinal axis. A deflector is supported by the body and spaced from the outlet, and the body has an outer encasing surface surrounding the longitudinal axis, the outer encasing surface including a leading portion and a trailing portion. The trailing portion is engaged with the gripping portion and has a first retention section and a second retention section different than the first retention section.

In some embodiments, a method of decoupling a fire protection sprinkler having a body with a leading portion and a trailing portion from a connection fitting having an internal sealing surface and a gripping portion is provided. The method includes withdrawing, extracting or pulling a first retention section from the gripper portion in a first direction in a first manner; and withdrawing, extracting or pulling a second retention section through the gripper portion in a second manner different than the first to decouple the fire protection sprinkler from the connection fitting. In some embodiments, the method includes withdrawing, extracting, pulling and, in some embodiments, unthreading a first retention thread from the gripper portion in a first direction; and unthreading a second retention thread through the gripper portion in a second direction opposite the first direction to decouple the fire protection sprinkler from the connection fitting.

The sprinkler assembly and its fitting connected to a fluid supply pipe and under fluid pressure, the sprinkler body can be rotated to begin to withdraw the sprinkler body from the fitting. Continued relative rotation can initially separate the sealed engagement between the sprinkler body thereby providing pressure relief, if necessary, before completely separating the sprinkler body and the fitting. Thus, the sprinkler assembly can provide a safety mechanism for replacing and maintaining an installed sprinkler.

BRIEF DESCRIPTION OF THE DRAWINGS

The accompanying drawings, which are incorporated herein and constitute part of this specification, illustrate embodiments of the present disclosure, and together, with the general description given above and the detailed description given below, serve to explain the features of the present disclosure. It should be understood that the disclosed embodiments are some examples of the present disclosure as provided by the appended claims.

DETAILED DESCRIPTION

The present disclosure relates generally to fire protection devices and more specifically to fire protection sprinkler and pipe connection assemblies. For taper threaded fire protection sprinklers, relief of system and/or residual fluid pressure is the natural result of unthreading the sprinkler's connection from the fluid supply piping. By partially unthreading a sprinkler, the fluid tight seal between the components is broken and any fluid pressure between the supply piping and the sprinkler is relieved while maintaining the components coupled together. For sprinklers that use components other than the mechanical threading to form a fluid tight seal, such as for example using an O-ring gasket, the present solution can enable coupling mechanisms that can release the fluid pressure before completely decoupling the sprinkler from the supply piping.

Figure 1:
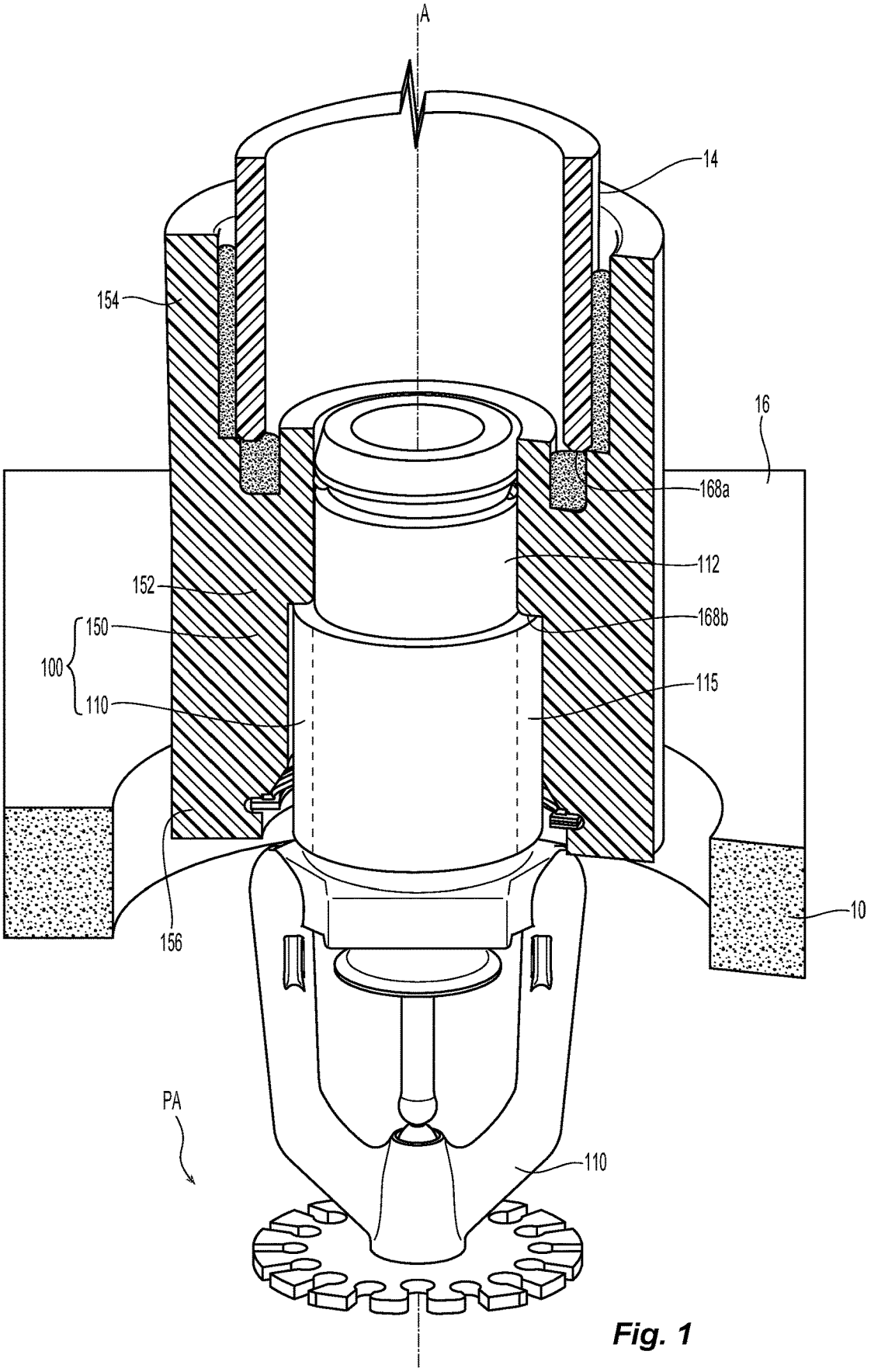
FIG. 1 is a schematic diagram of an embodiment of a sprinkler assembly in an illustrative installation.

FIG. 1 depicts is a sprinkler assembly 100 for the protection of an area, i.e., the protection area PA. The sprinkler assembly 100 is mounted through a barrier 10, such as for example, a ceiling barrier 10, through a hole opening in the ceiling barrier 10 for connection to a firefighting fluid supply pipe or pipe fitting 14 confined behind the ceiling barrier 10. The sprinkler assembly 100 includes a fire protection sprinkler 110 and a connection fitting 150 to connect the sprinkler 110 to fluid supply piping or fitting 14. One end of the fitting 150 is configured for connection to the fluid supply fitting 14. At the opposite end, the fitting 150 provides for connection to the sprinkler 110. In some embodiments, the connection between the fitting 150 and the sprinkler 110 is formed by axially inserting or pushing the sprinkler 110 into the end of the fitting 150 to form a fluid tight connection. The assembly 100 maintains the connection and resists decoupling between the sprinkler 110 and the fitting 150. In some embodiments, the sprinkler 110 can include an arrangement of retention mechanisms that cooperates with the fitting 150 to facilitate the coupling and decoupling between the components to control their separation and relieve system and/or residual fluid pressure. In some embodiments, the sprinkler includes differing retention sections and/or operations to prevent inadvertent decoupling between the sprinkler 110 and the fitting 150.

In some embodiments, the supply piping and pipe fittings are constructed from thermoplastic material, such as Chlorinated Poly Vinyl Chloride (CPVC) material suitable for use in fire sprinkler systems. The fitting 150 can be constructed from similar materials. The supply pipe or fittings and the sprinkler can be formed from metallic material, such as for example, steel, brass, bronze etc. The body of the sprinkler can be fabricated from an appropriate material using any suitable fabrication technique.

FIGS. 2A-2F depict an embodiment of a sprinkler assembly in varying states of being coupled, unsealed and sealed. The fire protection sprinkler 110 has a body 112 that includes an internal surface 112*a* extending along a first longitudinal axis A-A defining an internal passageway 114 extending between an inlet 116 and an outlet 118 of the body 112 for the respective receipt and discharge of the supplied fire-fighting fluid. The fire protection sprinkler 110 can be configured as an automatic sprinkler having a sealed assembly disposed within the outlet 118 supported by a thermally responsive trigger, as depicted, for example, in FIG. 1 (not depicted in FIGS. 2A-2E). The sprinkler 110 includes a deflector 124 supported by the body 112 and spaced from the outlet 118. As depicted, the deflector 124 can be secured to a pair of frame arms 126 which depend from the sprinkler body 112. As depicted, the frame arms 126 locate the deflector 124 at the desired fixed axial distance from the outlet 118. In some embodiments, the frame arms can provide for a "drop down" arrangement in which the arms deploy from an unactuated concealed position to an actuated deployed position. The internal passageway 114 and outlet 118 are dimensioned and geometrically configured so as to affect desired discharge characteristics for the deflector 124 to provide for a sprinkler spray pattern that can effectively address a fire. The deflector can have any suitable geometry and configuration for a particular application. For example, the deflector can be configured as a substantially planar member used in a pendent configuration or a hooded deflector for use in a horizontal orientation. The deflector can be domed for an upright sprinkler construction.

Figure 2A:
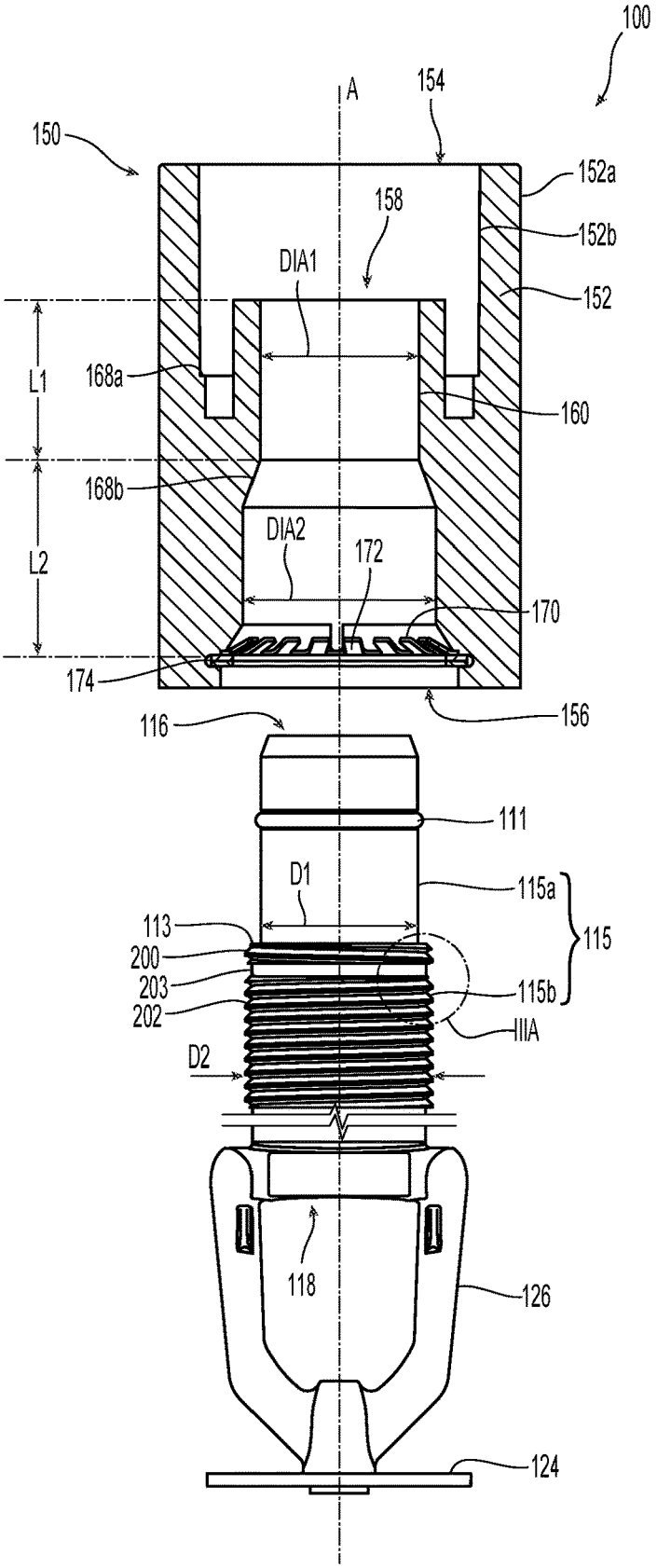
FIG. 2A is a cross-sectional exploded view of an embodiment of a sprinkler assembly for use in the installation of FIG. 1.
Figure 2B:
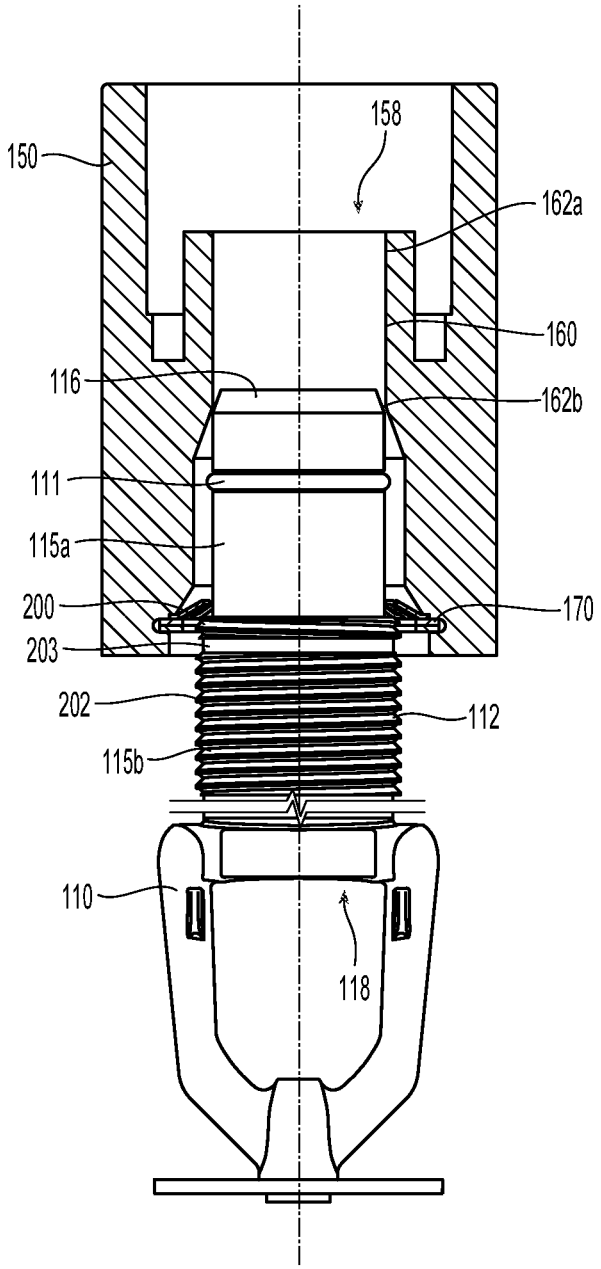
FIGS. 2B-2C are cross-sectional views of the sprinkler of FIG. 2A in a coupled unsealed condition.

With reference to FIGS. 2A and 2B, the fitting 150 includes a tubular member 152 with a first insertion end 154 for insertion and connection of the fluid supply pipe or fitting 14 and a second insertion end 156 for insertion and receipt of the sprinkler 110. The tubular member 152 includes an exterior surface 152*a* and an inner surface 152*b* that defines an internal conduit 158 which extends along a longitudinal axis A-A. A portion of the inner surface 152*b* of the tubular member 152 can define or form a sealing surface portion 160 which circumscribes the second longitudinal axis A-A and extends axially to define an axial length L1 between the first and second insertion ends 154, 156. In some embodiments, the sealing surface 160 forms a fluid tight seal with the sprinkler 110. The inner surface 152*b* of the fitting 150 includes a gripping portion 170, axially disposed between the sealing surface 160 and the second insertion end 156, to retain and adjustably locate the sprinkler 110 within the fitting 150. The gripping portion 170 can be embodied as a gripper ring 170 affixed along the inner surface 152*b* of the tubular member 152. As depicted, the sealing surface 160 can define an internal diameter DIA1 that is smaller than the internal diameter DIA2 defined by the gripper portion 170. The inner surface 152*b* of the fitting 150 can include stop surfaces to limit the insertion of the fluid supply pipe fitting 14 and the sprinkler 110. In some embodiments, internally from the first end 154 of the tubular member 152 is a first stop surface 168*a* spaced from the first end 154 to define an insertion depth for the fluid supply pipe 14 and a second stop surface 168*b* to limit insertion of the sprinkler 110.

The body 112 has an outer encasing surface 115 that surrounds the longitudinal axis A-A. The outer encasing surface 115 includes a leading portion 115*a* and a trailing portion 115*b* for insertion in the second insertion end 156 of the fitting 150. The leading portion 115*a* can include a sealing member 111 and define a first diameter D1 sized to support the annular sealing member 111, such as for example, an O-ring, in engagement with the cylindrical sealing surface 160 of the fitting 150. The trailing portion 115*b* has a second diameter D2 that can be greater than the first diameter D1. The trailing portion 115*b* can form a mechanical connection with the gripper portion 170 to adjustably locate and retain the sprinkler 110 within the fitting 150. The difference in diameters D1, D2 between the leading and trailing portions defines a step transition or shoulder surface 113 separating the first portion and second portions of the encasing surface 115 which contacts the second stop surface 168*b* of the tubular member 152 to define the insertion limit of the sprinkler 110.

The trailing portion 115*b* of the outer encasing surface 115 can include or define a surface for the adjustable mechanical connection with the internal gripper ring 170 of the fitting 150. In some embodiments, the trailing portion includes a first retention section 200 and a second retention section 202 different than the first retention section. In some embodiments, the differences in the retention structures 200, 202 require additional or different operation to detach the sprinkler 110 from the fitting 150. In some embodiments, a relief section 203 or break is formed between the first and second retention sections 200, 202 to separate the variable sections.

Figure 3A:
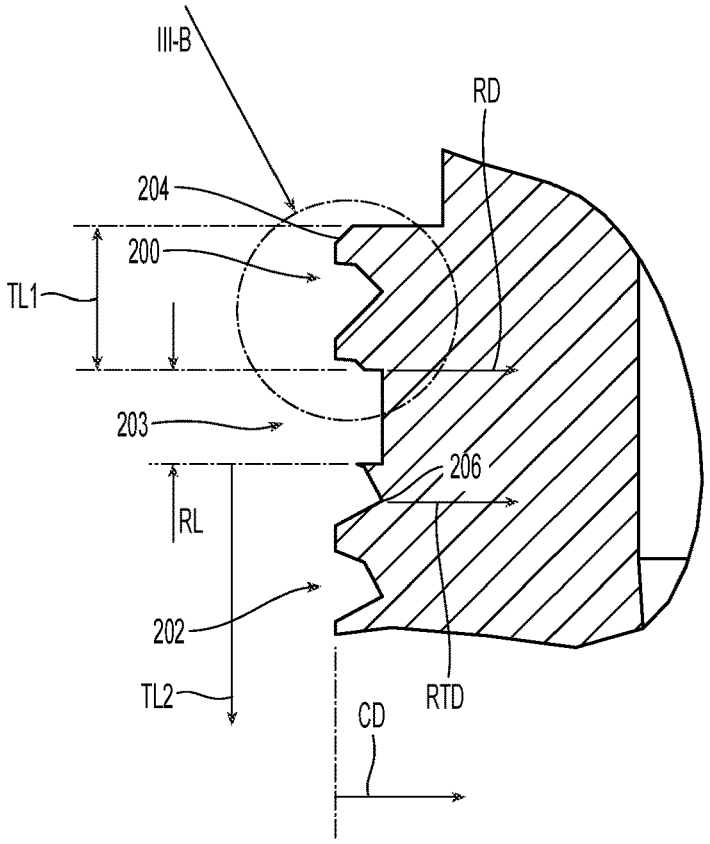
FIG. 3A is a detailed view of a thread used in the sprinkler assembly at III-A in FIG. 2A.
Figure 3B:
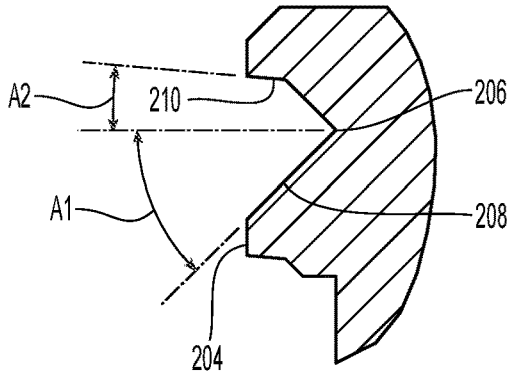
FIG. 3B is a detailed view of the thread at III-B of FIG. 3A.

Each of the first and second retention sections 200, 202 can be embodied as a helical thread. For example, the threads can be a buttress thread, square thread, a straight thread and/or a swept thread. FIGS. 3A and 3B depict each thread 200, 202 to include thread components, such as for example, a crest 204, a root 206, adjacent flank faces 208, 210, which define respective thread parameters, such as for example, thread handedness (right or left), a thread length (TL1, TL2), pitch or threads per inch (TPI), crest diameter CD, root diameter RD, relief diameter RTD, relief length RL and/or flank angles A1, A2.

The first and second threads 200, 202 can vary from one another in any manner and in one or more ways provided the variance facilitates controlled decoupling in a manner as described herein. In some embodiments, the first and second threads 200, 202 define threads or handedness that is counter to one another. For example, the first thread 200 is a left handed thread and the second thread 202 is a right handed thread. The handedness can be reversed. In some embodiments, the first thread 200 has a thread length TL1 that is less than the second thread length TL2 of the second thread 202. In some embodiments, the first thread length TL1 provides for at least two revolutions in its rotational engagement with the gripper ring 170.

In addition to rotationally engaging the gripper ring 170, the retention sections and, in some embodiments, the threads 200, 202, contact and angularly displace or flex elements of the gripper ring 170. In some embodiments, each of the first and second threads 200, 202 is a swept thread in which adjacent flank faces 208, 210 having respectively a first flank angle A1 and a second flank angle A2. The first flank angle A1 can be equal to or be greater than thirty degrees and the second flank angle A2 can be less than thirty degrees. In some embodiments, the first flank angle A1 is forty-five degrees and the second flank angle is less than ten degrees and is five degrees in some embodiments. The steeper angle A1 can facilitate the angular displacement of the gripper ring elements upon receipt of the sprinkler body 112. The shallower angle A2 of the threads can facilitate retention of the sprinkler within the fitting 150.

In some embodiments, such as in which the trailing portion defines the largest diameter of the body, the crest diameter CD of the external threading defines the diameter of the trailing portion 115*b*. In some embodiments, such as where the sprinkler body 112 having an outlet 118 with a diameter of 0.5 inch, each of the first and second threads define a crest diameter ranging from 0.5 inch to 3 inch and is about 0.85 to 0.9 inch in some embodiments. The root diameter RTD defines the narrowest portion of the first and second threading 200, 203. In some embodiments, the root diameter RTD is equal to or greater than the diameter defined by the floor of the relief section or its narrowest relief diameter RD. The relief diameter RD can range from 0.75 to 1 inch. The relief diameter RD can range from about 0.8 to 0.85 inch. The axial length RL of the relief section can be sufficient to sense the relief section 203 when traversing between threads 200, 202 upon rotation of the ring 170. Accordingly, the relief section can provide an indicator of the transition from one retention section to the next. In some embodiments, the axial length RL of the relief section is about 0.05-0.075 inch and about 0.06 inch in some embodiments.

Figure 2C:
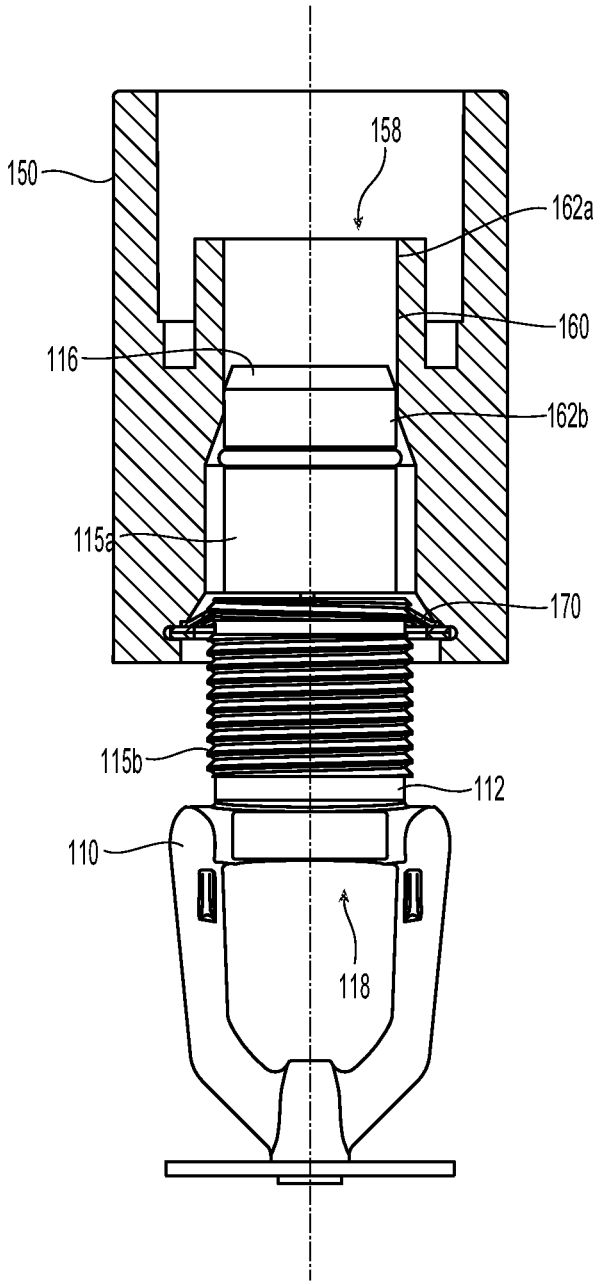
Figure 2D:
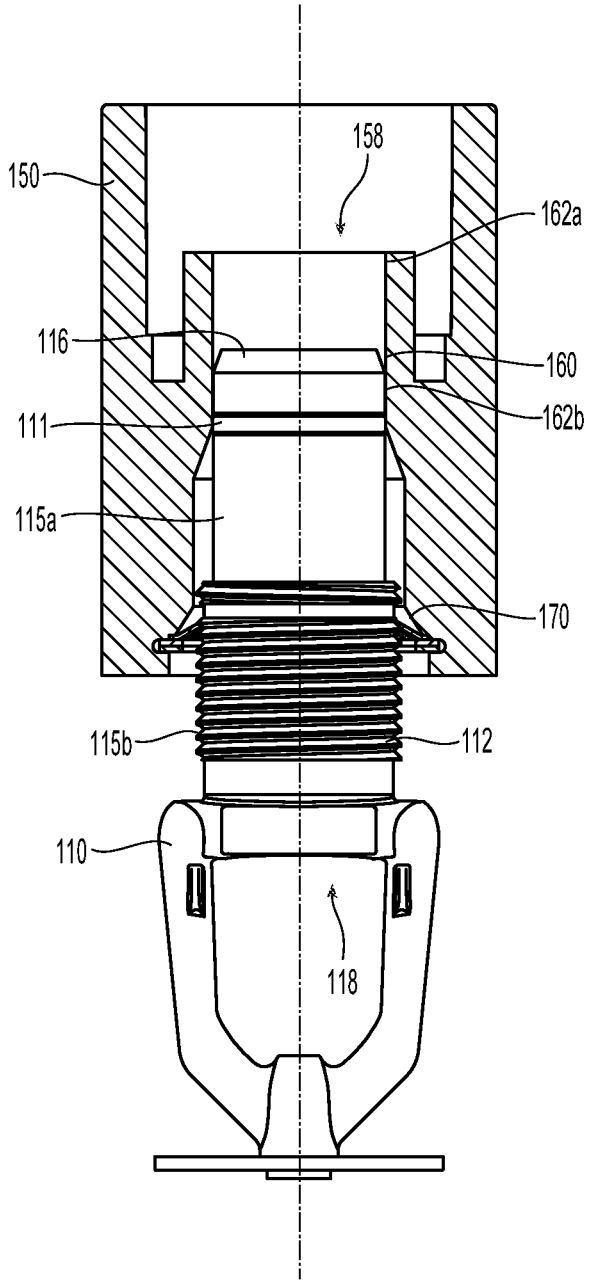
FIGS. 2D-2F are cross-sectional views of the sprinkler of FIG. 2A in a coupled sealed condition.
Figure 2E:
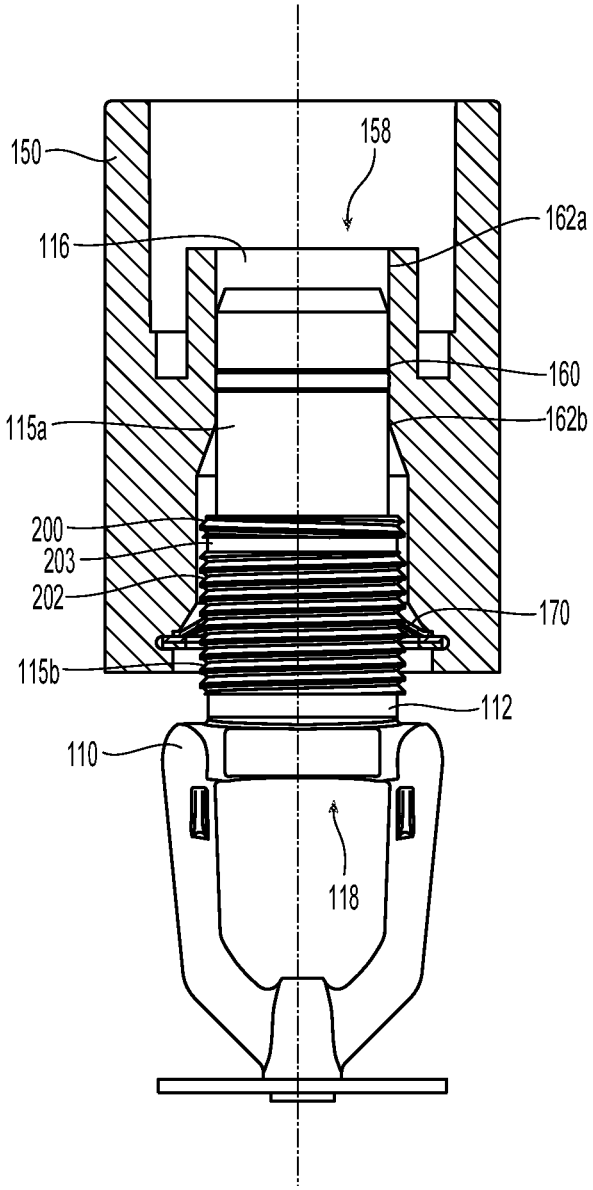
Figure 2F:
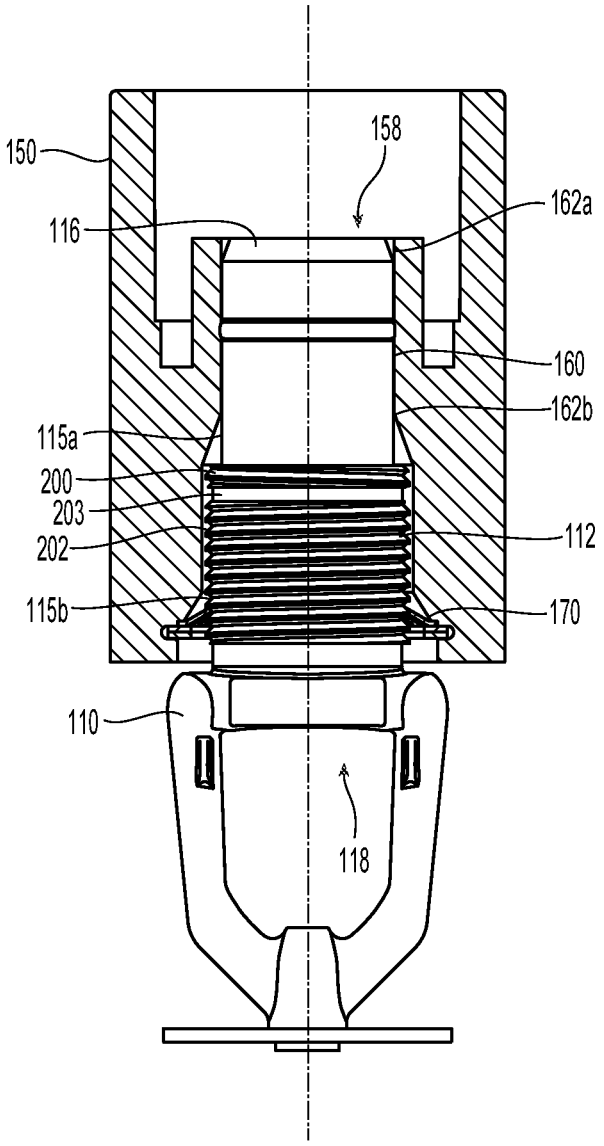

In some embodiments, the gripper ring 170 includes an annular base 174 from which fingers or prongs 172 extend radially inward and are equiangularly spaced about the ring's center. Each of fingers or prongs 172 is a resilient member which flexes with respect to the annular base 174 to vary the distance of the radially innermost end 172*a* of the finger from the ring center. The gripper ring 170 can be affixed within the tubular member 152 to circumscribe the longitudinal axis. In assembling the fitting 150 and the sprinkler 110, the sprinkler 110 can be initially inserted into the tubular member 152 axially or linearly pushed or driven into the fitting 150. The contact between the gripper ring 170 and the retention sections 200, 203 can cause the fingers or prongs 172 of the gripper ring 170 to splay outwardly. In some embodiments, the steeper angle A1 of the first flank face 208 provides a surface to engage and displace the fingers 172 of the gripper ring 170. With the prongs of the gripper ring 170 splayed outwardly, the sprinkler body can be linearly inserted into position within the fitting 150 to first locate the inlet 116 of the sprinkler 110 within the sealing surface 160, as depicted in FIG. 2B. The sprinkler 110 is further advanced into the fitting 150 to engage the first left handed thread 200 with the gripper ring 170, as depicted in FIG. 2C, to mechanically connect and couple the fitting 150 and the sprinkler 110. FIG. 2D depicts the sprinkler 110 being further inserted such that the gripper ring engages the relief section 203 to form an initial fluid tight sealing contact between the sealing member 111 and the sealing surface 160. In FIG. 2E, the sprinkler 110 is further advanced into the fitting 150 to engage the second right handed thread 202 with the gripper ring 170 to mechanically connect and maintain the coupled arrangement between the fitting 150 and the sprinkler 110. In FIG. 2F, the gripper ring is fully engaged with the second thread 202 to locate the deepest position of the sealing member 111 within the sealing surface 160. With the sealing member 111 in sealing contact with the sealing surface 160, fluid supplied to the pipe fitting 14, places the assembly under fluid pressure. The shallow angle A2 of the second flank face 210 of the threading 200, 202, prevents the sprinkler 110 from being ejected under either fluid pressure or by inadvertent contact.

In order to maintain or inspect the installed sprinkler 110, it may become necessary to separate or decouple the sprinkler 110 from the fitting 150. However, due to the shallow angle A2 of the second flank face 210, the sprinkler cannot be pulled out from the fitting 150. Instead, the sprinkler must be unthreaded out of the fitting 150. In some embodiments, as previously noted, it is desirable to relieve fluid pressure before separating the sprinkler 110 from the fitting 150. The retention sections and threading 200, 202 can accomplish this function.

Figure 4:
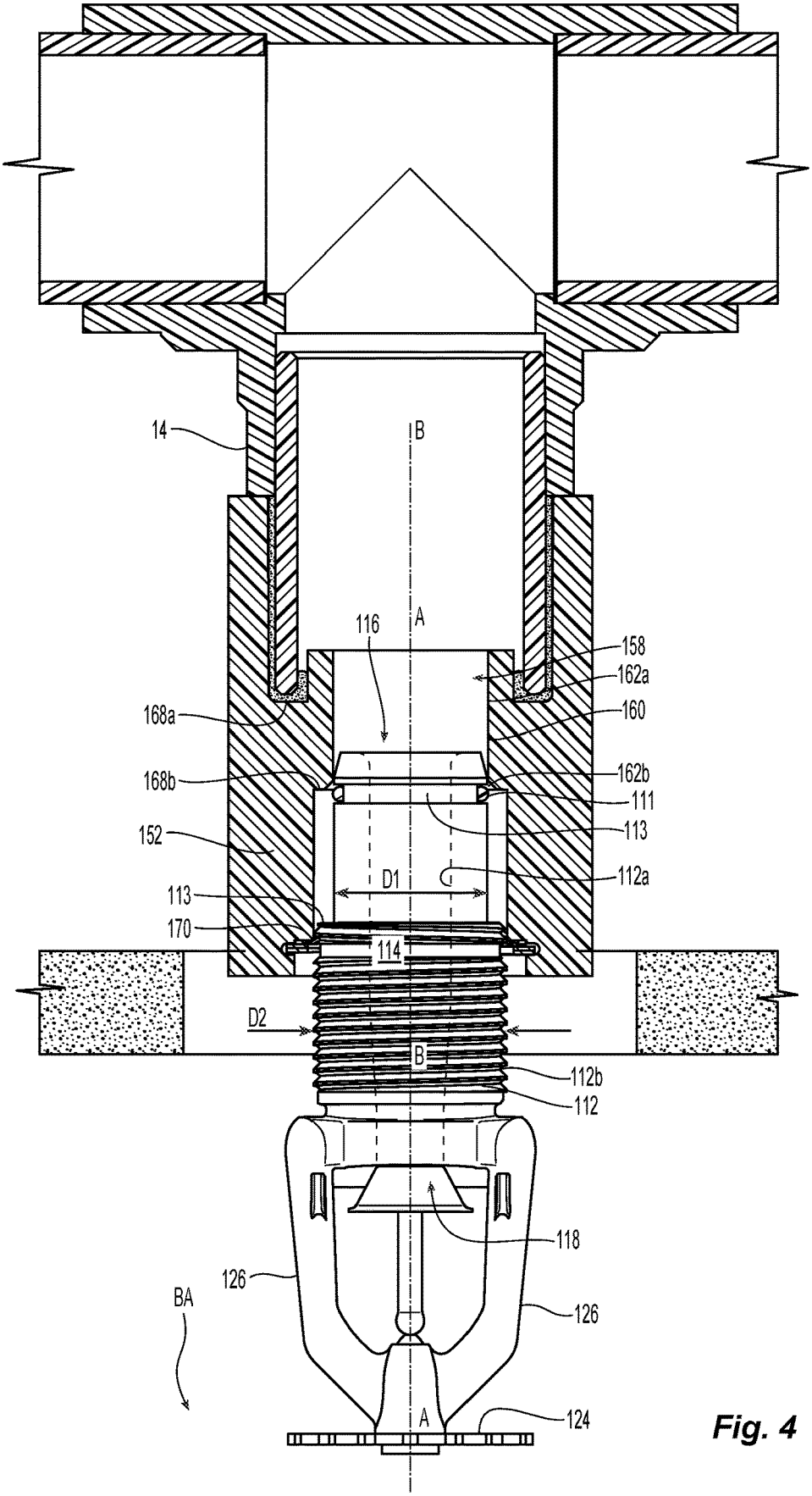
FIG. 4 is a diagram of an embodiment of a sprinkler assembly installation in a coupled unsealed state.

Referring to FIG. 2F, under fluid pressure, the sprinkler 110 and its second right handed thread 202 can be unthreaded to back the sprinkler out and disengage the gripper ring 170 from the second thread 202. As depicted for example in FIGS. 2E and 4, the gripper ring engages the relief section 203. Contact between the gripper ring 170 and the relief section indicates the disengagement from the second thread 202 and the adjacent first thread 200. In the installed assembly, the sprinkler is still under fluid pressure at this point in the process. Using a counter unthreading rotation for the first left handed threading 200, the gripper ring 170 engages the first thread 200 in a threaded engagement. Once the first thread 200 is engaged, the seal member 111 can be disengaged from the sealing surface 160, as depicted in FIG. 2C, thereby relieving the fluid pressure from the assembly. Continued counter unthreading of the first thread 200 through the gripper ring 170, such as over at least two revolutions, decouples the sprinkler 110 from the fitting 150 for maintenance or replacement.

In addition to coupling and decoupling the sprinkler assembly components, the second threading 202 can provide for adjustability of the sealing location. FIGS. 2E and 2F depict that the sprinkler assembly has a range of sealing member positions. By using the threaded engagement with the gripper ring 170, the second thread 202 can adjust the axial location of the sealing member 111 along the sealing surface 160. The range and fineness of the adjustability can be defined by the threads per inch (TPI) and/or pitch of the second thread 202. In some embodiments, the second thread defines a TPI ranging from 15 to 45, from 15 to 35 or from 15 to 25. In some embodiments, the TPI is 16. By providing a range of locations over which a fluid tight seal can be formed, there is flexibility in completing the sprinkler assembly 100 and the relative spacing between the components of the assembly 100 and/or installation structures. For example, the adjustability provides for adjustment of the deflector 124 with respect to the tubular member 152 or with respect to other installation structures, such as the ceiling barrier 10 depicted in FIG. 4. The sprinkler assembly can include a sealing surface that has an axial length defining a range of axial adjustment of the deflector with respect to the sealing surface.

Figure 5:
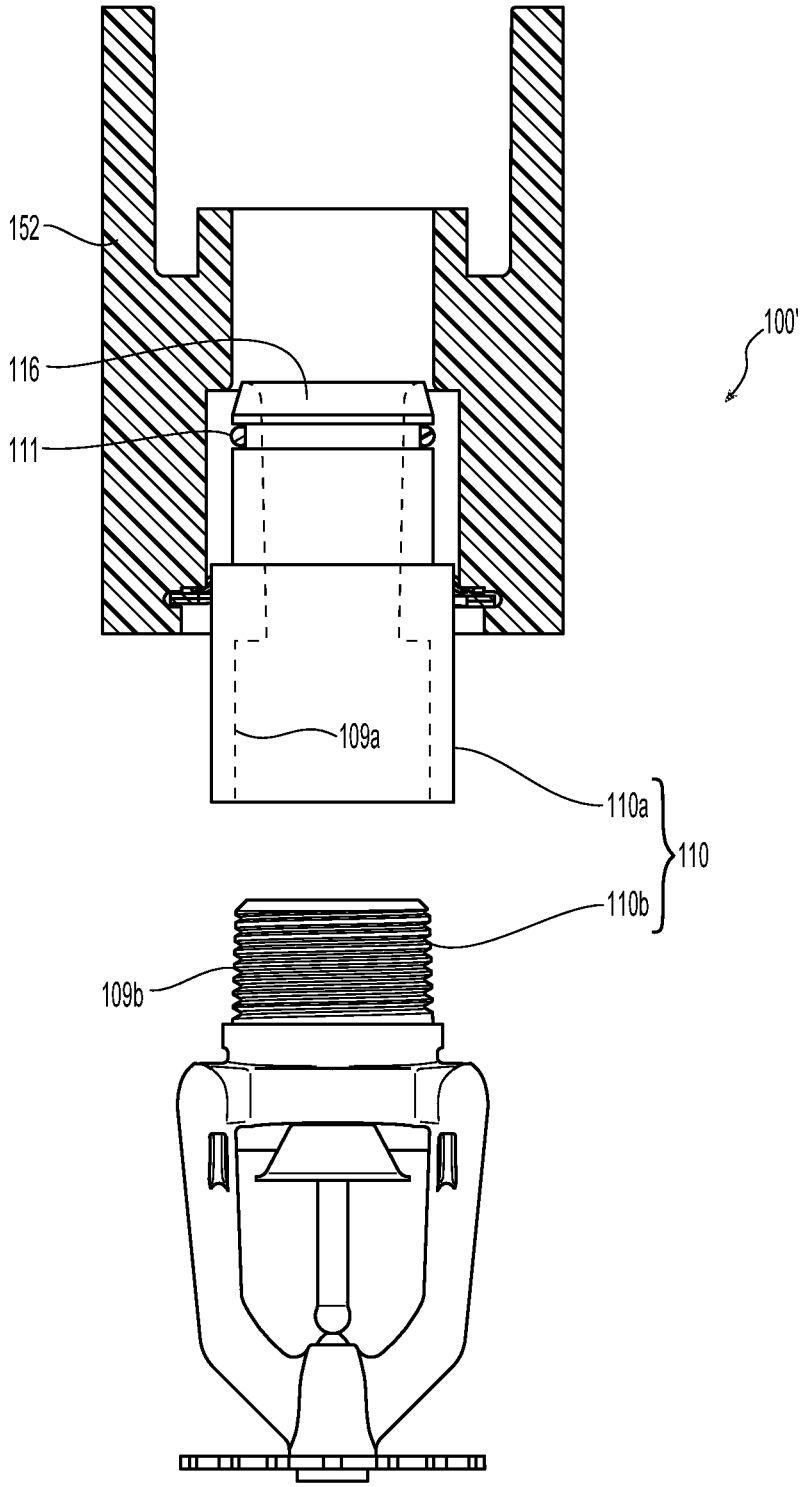
FIG. 5 is a diagram of an embodiment of the sprinkler assembly for use in the installations of FIG. 1.

As has been described herein, the sprinkler assembly 100 can include a sprinkler body 110 that is integrally formed. In some embodiments, as depicted in FIG. 5, a sprinkler assembly 100' includes a sprinkler body 110 that includes a sprinkler insert 110*a* and a separate sprinkler component 110*b* that is coupled to the insert 110*a*. The insert 110*a* includes an encasing surface having the leading and trailing portions 115*a*, 115*b* as previously described. The insert 110*a* also includes an internal thread 109*a* for complimentary threaded engagement with the external thread 109*b* of the sprinkler component 110*b*. The external thread 109*b* can be a tapered thread, such as for example, NPT thread. The sprinkler 110*b* can be an externally threaded sprinkler for engagement with insert 110*a* and assembled with the fitting 150. Accordingly, the assembly 100' can provide for an adapter to convert a standard threaded sprinkler into a sprinkler assembly for push-to-connect-rotate-to installation.

While the present disclosure has been disclosed with reference to certain embodiments, numerous modifications, alterations, and changes to the described embodiments are possible without departing from the sphere and scope of the present disclosure, as defined in the appended claims. Accordingly, it is intended that the present disclosure not be limited to the described embodiments, but that it has the full scope defined by the language of the following claims, and equivalents thereof

What is claimed is:

1. A sprinkler assembly comprising:

a connection fitting including a tubular member with a first insertion end and a second insertion end with an internal conduit extending between the first and second insertion end along a longitudinal axis, the tubular member including an exterior surface and an inner surface, the inner surface defining a sealing surface between the first and second insertion ends circumscribed about the longitudinal axis, the inner surface including a gripping portion axially spaced from the sealing surface between the sealing surface and the second insertion end; and a fire protection sprinkler having a body defining an inlet and an outlet with a passageway extending between the inlet and the outlet along the longitudinal axis, a deflector supported by the body and spaced from the outlet, the body having an outer encasing surface surrounding the longitudinal axis, the outer encasing surface including a leading portion and a trailing portion, the trailing portion being engaged with the gripping portion, the trailing portion having a first retention section, a second retention section different than the first retention section, and a relief portion between the first retention section and the second retention section, the first retention section having a first thread, the second retention section having a second thread, a first crest diameter of the first thread and a second crest diameter of the second thread are equal and are greater than a relief diameter of the relief section; and wherein the second thread is counter to the first thread.

2. The sprinkler assembly of claim 1, wherein the second thread is counter to the first thread.

3. The sprinkler assembly of claim 2, wherein each of the first and second thread defines a total thread length, the total thread length of the first thread being less than the total thread length of the second thread.

4. The sprinkler assembly of claim 3, wherein the first thread defines at least two revolutions of the first thread.

5. The sprinkler assembly of claim 3, wherein the first thread is located between the inlet of the sprinkler body and the second thread.

6. A sprinkler assembly, comprising: a connection fitting including a tubular member with a first insertion end and a second insertion end with an internal conduit extending between the first and second insertion end along a longitudinal axis, the tubular member including an exterior surface and an inner surface, the inner surface defining a sealing surface between the first and second insertion ends circumscribed about the longitudinal axis, the inner surface including a gripping portion axially spaced from the sealing surface between the sealing surface and the second insertion end; and a fire protection sprinkler having a body defining an inlet and an outlet with a passageway extending between the inlet and the outlet along the longitudinal axis, a deflector supported by the body and spaced from the outlet, the body having an outer encasing surface surrounding the longitudinal axis, the outer encasing surface including a leading portion and a trailing portion, the trailing portion being engaged with the gripping portion, having a first retention section and a second retention section different than the first retention section, wherein each of the first and second thread is a swept thread having a first flank angle and a second flank angle, the first flank angle being equal or greater than thirty degrees and the second flank angle being less than thirty degrees and wherein the second thread is counter to the first thread.

7. The sprinkler assembly of claim 6, wherein the first flank angle is forty-five degrees and the second flank angle is less than ten degrees.

8. The sprinkler assembly of claim 7, wherein the second flank angle is five degrees.

9. The sprinkler assembly of claim 1, wherein the first crest diameter and the second crest diameter are between from 0.75 inch to 1 inch.

10. The sprinkler assembly of claim 9, wherein the leading portion defines a diameter less than the crest diameter.

11. The sprinkler assembly of claim 10, wherein the outlet of the sprinkler body is about 0.5 inch.

12. The sprinkler assembly of claim 1, wherein each of the first thread and the second thread define a pitch equal to or greater than the axial length of the relief section.

13. The sprinkler assembly of claim 1, wherein each of the first thread and the second thread define a root diameter equal to or greater than the relief diameter.

14. A method of decoupling a fire protection sprinkler having a body with a leading portion and a trailing portion from a connection fitting having an internal sealing surface in fluid tight sealed contact with the leading portion and a gripping portion coupled to the trailing portion, the trailing portion having a first retention section, a second retention section different than the first retention section, and a relief portion between the first retention section and the second retention section, the first retention section having a first thread, the second retention section having a second thread, a first crest diameter of the first thread and a second crest diameter of the second thread are equal and are greater than a relief diameter of the relief section, the second thread is counter to the first thread, the method comprising:

withdrawing the first retention section from the gripper portion in a first manner; and withdrawing the second retention section from the gripper portion in a second manner different than the first manner.

15. The method of claim 14, further including spacing the first thread from the second thread by engaging the gripper portion with the relief section.

16. The method of claim 14, wherein the first manner includes breaking a fluid tight seal between the sprinkler body and the connection fitting.

17. The method of claim 14, wherein the second manner includes unthreading the second thread from the gripper portion in a direction opposite the first thread.

18. The method of claim 17, wherein unthreading the second thread decouples the sprinkler body from the connection fitting.

* * * * *